US009155335B2

(12) United States Patent
Robertson et al.

(10) Patent No.: US 9,155,335 B2
(45) Date of Patent: Oct. 13, 2015

(54) DEGRADABLE CIGARETTE FILTER

(75) Inventors: Raymond M. Robertson, Blacksburg, VA (US); William C. Thomas, Pembroke, VA (US)

(73) Assignee: Celanese Acetate LLC, Irving, TX (US)

( * ) Notice: Subject to any disclaimer, the term of this patent is extended or adjusted under 35 U.S.C. 154(b) by 1077 days.

(21) Appl. No.: 12/135,264

(22) Filed: Jun. 9, 2008

(65) Prior Publication Data

US 2009/0151738 A1 Jun. 18, 2009

Related U.S. Application Data

(60) Provisional application No. 61/014,210, filed on Dec. 17, 2007.

(51) Int. Cl.

| | |
|---|---|
| ***A24D 3/10*** | (2006.01) |
| ***A24D 3/06*** | (2006.01) |
| ***A24D 3/14*** | (2006.01) |

(52) U.S. Cl.

CPC *A24D 3/10* (2013.01); *A24D 3/068* (2013.01); *A24D 3/14* (2013.01)

(58) Field of Classification Search

CPC ..... A24D 3/10; A24D 3/068

See application file for complete search history.

(56) References Cited

U.S. PATENT DOCUMENTS

| | | | | |
|---|---|---|---|---|
| 3,526,904 | A | 9/1970 | Tamol | |
| 5,478,386 | A | 12/1995 | Itoh et al. | |
| 5,491,024 | A | 2/1996 | Brodof et al. | |
| 5,495,860 | A | 3/1996 | Teufel et al. | |
| 5,609,677 | A | 3/1997 | Itoh et al. | |
| 5,647,383 | A | 7/1997 | Brodof et al. | |
| 5,706,833 | A | 1/1998 | Tsugaya et al. | |
| 5,722,433 | A * | 3/1998 | Ishino et al. | 131/365 |
| 5,804,296 | A | 9/1998 | Itoh et al. | |
| 5,913,311 | A | 6/1999 | Ito et al. | |
| 5,947,126 | A | 9/1999 | Wilson et al. | |

(Continued)

FOREIGN PATENT DOCUMENTS

| | | |
|---|---|---|
| BR | PI0604399 2 A | 5/2008 |
| JP | 07-031451 | 2/1995 |

(Continued)

OTHER PUBLICATIONS

Haward, et al, "The Heterogeneous Acid and Acid Salt Hydrolysis of Secondary Cellulose Acetate," p. 63-64, (Feb. 1946).

(Continued)

*Primary Examiner* — Michael J Felton

(74) *Attorney, Agent, or Firm* — Kilpatrick Townsend & Stockton LLP

(57) ABSTRACT

A degradable cigarette filter includes a filter element of a bloomed cellulose acetate tow, a plug wrap surrounding the filter element, and either a coating or a pill in contact with the tow. The coating and/or pill may be composed of a material adapted to catalyze hydrolysis of the cellulose acetate tow and a water-soluble matrix material. The material may be an acid, an acid salt, a base, and/or a bacterium adapted to generate an acid. The coating may be applied to the tow, the plug wrap, or both. The pill may be placed in the filter element. When water contacts the water-soluble matrix material, the material adapted to catalyze hydrolysis is released and catalyzes the hydrolysis, and subsequent degradation, of the cellulose acetate tow. The foregoing is also applicable to articles made of cellulose esters.

11 Claims, 3 Drawing Sheets

(56) References Cited

U.S. PATENT DOCUMENTS

| | | | |
|---|---|---|---|
| 6,475,758 | B2 | 11/2002 | Reaney |
| 6,571,802 | B1 | 6/2003 | Yamashita |
| 6,739,344 | B2 | 5/2004 | Yamashita |
| 2002/0009785 | A1 | 1/2002 | Reaney |
| 2002/0096300 | A1 | 7/2002 | Yamashita |
| 2002/0128184 | A1 | 9/2002 | Chokshi |
| 2008/0251091 | A1 | 10/2008 | Schuetz et al. |

FOREIGN PATENT DOCUMENTS

| | | |
|---|---|---|
| JP | 09-037774 | 2/1997 |
| JP | 9-37799 A | 2/1997 |
| WO | WO 9220738 | 11/1992 |

OTHER PUBLICATIONS

Vos, et al, "Kinetic Study of the Hydrolysis of Cellulose Acetate in the pH Range of 2-10," Journal of Applied Polymer Science, p. 825-832, (1966).

Office Action for corresponding European Appl. No. 08860857.5-1357 dated Jun. 16, 2014.

Chinese Office Action mailed on Feb. 16, 2015 for CN Patent Application No. 200880121072.4, with English translation, 20 pages.

* cited by examiner

DEGRADABLE CIGARETTE FILTER

RELATED APPLICATIONS

This application claims the benefit of earlier filed U.S. Provisional Application Ser. No. 61/014,210 filed Dec. 17, 2007.

FIELD OF THE INVENTION

This invention is directed to a degradable cigarette filter and degradable articles made of cellulose ester polymers.

BACKGROUND OF THE INVENTION

Cigarette filters are made of bloomed cellulose acetate tow. Specifically, the cellulose acetate tow is a cellulose diacetate with a Degree of Substitution (D.S.) in the range of 2.0 to 2.6. The cigarette filter includes a filter element formed from the tow and wrapped with a plug wrap. Later, the cigarette filter may be attached to the wrapped tobacco column of a cigarette.

After the cigarette has been smoked, the cigarette filter (or butt) is discarded. If the butt is discarded improperly (e.g., thrown on the ground), it becomes an unsightly piece of litter. In recent years, more cigarette smokers have been forced to move outside to smoke. This effort has increased the amount of improperly discarded butts.

Cellulose acetate used in cigarette filters will degrade over time; the time to degrade, however, can be long (e.g., >4 year). Therefore, there is a need to accelerate the degradation of the cellulose acetate in butts.

Prior attempts have been made to accelerate the degradation of cigarette butts. These prior attempts to accelerate degradation involved adding a degradation promoting agent into the cellulose acetate tow during its manufacture. In U.S. Pat. Nos. 5,491,024 and 5,647,383, a photo-degradation agent, ultra fine titanium dioxide ($TiO_2$), is added into the cellulose acetate tow during its manufacture. In U.S. Pat. Nos. 6,571,802 and 6,739,344, biodegradation promoting (or decomposition accelerating) agents and/or reaction controlling agents are added into the cellulose acetate tow during its manufacture. The biodegradation promoting agents include oxygen acid of phosphorus, oxygen acid of sulfur, oxygen acid of nitrogen, a partial ester of hydrogen salt of the foregoing acids, carbonic acid and its hydrogen salt, a sulfonic acid and a carboxylic acid.

There is still a need for degradable cigarette filters in which the degradation agents are not added into the cellulose acetate tow during its manufacture.

SUMMARY OF THE INVENTION

A degradable cigarette filter includes a filter element of a bloomed cellulose acetate tow, a plug wrap surrounding the filter element, and either a coating or a pill in contact with the tow. The coating and/or pill may be composed of a material adapted to catalyze hydrolysis of the cellulose acetate tow and a water-soluble matrix material. The material may be an acid, an acid salt, a base, and/or a bacterium adapted to generate an acid. The coating may be applied to the tow, the plug wrap, or both. The pill may be placed in the filter element. When sufficient water contacts the water-soluble matrix material, the material adapted to catalyze hydrolysis is released and catalyzes the hydrolysis, and subsequent degradation, of the cellulose acetate tow. The foregoing is also applicable to articles made of cellulose esters.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
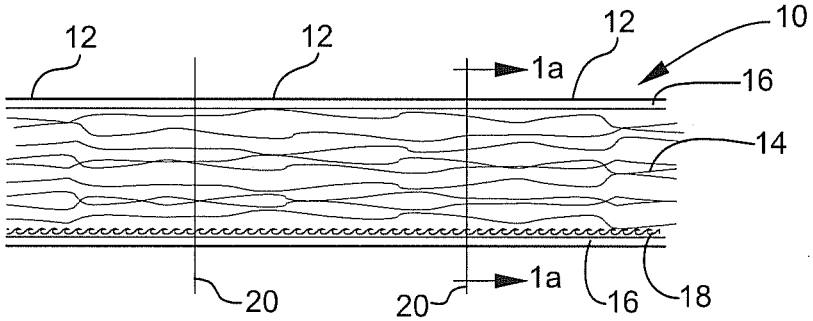
FIG. 1 is an illustration of a filter rod made according to the present invention.

A degradable cigarette filter generally includes a filter element (or filter plug) made of a bloomed cellulose acetate tow, a plug wrap surrounding the filter element, and either a coating or a pill in contact with the tow. The coating and the pill are made of a material for catalyzing the hydrolysis of the cellulose acetate tow and a water-soluble matrix material. The coating may be applied to the cellulose acetate tow after the tow is manufactured (i.e., not added to the spinning solution) and/or to the plug wrap. The pill may be added to the filter element during cigarette filter manufacture. The foregoing shall be explained in greater detail below.

A degradable cigarette filter, as used herein, refers to a cigarette filter that will decompose when exposed to an outdoor environment (i.e., exposed to rain, dew, or other sources of water). The degree of degradation is, at a minimum, sufficient to convert the cellulose acetate (in cigarette filters, cellulose acetate generally has a D.S. of 2.0-2.6) into cellulose (D.S.≤1.0), and, at a maximum, sufficient to convert the cellulose acetate into glucose. The time period for such degradation is less than the time for an equivalent amount of untreated cellulose acetate to decompose and typically may be several months (e.g., 2-6 months).

The coating and the pill are made of a material adapted to catalyze hydrolysis of the cellulose acetate tow and a water-soluble matrix material. Each of these components will be discussed in greater detail below.

The material adapted to catalyze hydrolysis of the cellulose acetate tow is any material that can catalyze hydrolysis of the cellulose acetate tow. Catalyze hydrolysis, as used herein, refers to the removal of an acetate moiety from the cellulose backbone. Ideally, all acetate moieties are removed, but such ideal conditions are not necessary for degradation, and a cellulose acetate with a D.S. of ≤1.0 is sufficient for degradation (e.g., attack by naturally occurring enzymes and bacteria). For hydrolysis of the cellulose acetate to occur, only the cellulose acetate, the material to catalyze hydrolysis, and water are typically necessary.

The material adapted to catalyze hydrolysis may be divided into several categories of materials: acids, acid salts, bases, and bacterium adapted to generate an acid. The acids should have a $pK_a$ of <6. The bases should have a $pK_b$ of <6. Materials from these categories are typically used alone, but combinations are possible.

The acids include: acetic, ascorbic, ascorbyl-2-phosphate, ascorbyl-2-sulfate, aspartic (aminosuccinic), cinnamic, citric, folic, glutaric, lactic, malic (1-hydroxysuccinic), nicotinic (nician), oxalic, succinic, tartaric, boric, hydrochloric, nitric, phosphoric, sulfuric, and combinations thereof. In most embodiments, either ascorbic, citric, lactic, or nicotinic acids are used.

Additionally, the acids may include a combination of a weak organic acid and a compound that can be hydrolyzed to a strong acid. In this combination, the weak organic acid hydrolyzes the compound, renders the strong acid, and the strong acid hydrolyzes the tow (typically to a sugar, e.g., glucose). Weak organic acids include: ascorbic acid, citric acid, lactic acid, nicotinic acid, hydroxysuccinic acid (apple acid), and combinations thereof. Compounds that can be hydrolyzed to a strong acid include: cellulose sulfate, dodecyl sulfate, ascobryl-2-sulfate, ascorbyl-2-phosphate, phosphorus pentoxide, phosphorus pentoxide based esters, cellulose nitrate, 2-ethyl hexyl phosphate, and combinations thereof.

The acid salts include: metal salts where said metal is selected from the group consisting of: aluminum, potassium, sodium, or zinc, and the non-metal portion of the salt is selected from the group consisting of nitrates, dihydrogen phosphates, hydrogen phosphates, phosphates hydrogen sulfates, sulfates, and combinations thereof. Also included as an acid salt are: alum (aluminum potassium sulfate) and aluminum ammonium sulfate. In most embodiments, either sodium hydrogen sulfate ($NaHSO_4$) or sodium dihydrogen phosphate ($NaH_2PO_4$) are used.

The bases include: metal hydroxides, calcium oxide (lime), urea, borax, sodium metasilicate, ammonium hydroxide, sodium carbonate, sodium phosphate tribasic, sodium hypochlorite, sodium hydrogen carbonate (sodium bicarbonate), and combinations thereof.

The bacterium may be either a bacterium that produces an acid or a bacterium that attacks and degrades the cellulose acetate directly. Bacterium that produces an acid typically must be provided with a food source. So, when this bacterium is released, by dissolving action of water, the bacterium digests the food source, produces a weak acid, and the weak acid catalyzes the hydrolysis of the cellulose acetate. The bacterium that produces an acid includes: lactobacillus acidophilus, bifidobacterium longum, acetobacterium woodii, acetobacter aceti (vinegar bacteria), and combinations thereof. The food sources for these bacteria are conventional and may include lactose, glucose, and/or triactin based materials. Bacterium that attacks and degrades cellulose acetate directly does not require the food source. The bacterium that attacks and degrades the cellulose acetate directly includes: rhizobium meliloti, alcaligenes xylosoxidans, and combinations thereof.

The water-soluble matrix material may be any material that can encapsulate (i.e., contain the material adapted to catalyze hydrolysis); but, when in contact with water, will dissolve and thereby allow catalysis of the hydrolysis. Encapsulation is important for, at least two reasons: first, encapsulation prevents premature hydrolysis, and second, maintains shelf-life of the product (filter). The water-soluble matrix material may be cellulose acetate (D.S.=0.8±0.2), carboxymethyl cellulose (CMC), ethyl cellulose, hydroxypropyl cellulose (HPC), hydroxypropyl methyl cellulose (HPMC), methyl cellulose, polyethylene glycol (PEG), polyvinyl acetate, polyvinyl alcohol, starch, sugar, and combinations thereof. The sugars may be glucose, sucrose, lactose, and combinations thereof. In most embodiments, the water-soluble matrix material may be carboxymethyl cellulose, hydroxypropyl cellulose, hydroxypropyl methyl cellulose, polyvinyl alcohol, polyethylene glycol, and combinations thereof.

The amount of the material adapted to catalyze hydrolysis present in the filter element must be sufficient to cause degradation of the cellulose acetate tow at a rate faster than an equivalent untreated filter element. For example, in one embodiment of the invention, the time for degradation may be 2-6 months. The amount of the material will depend upon, for example: the weight of the cellulose acetate in the filter element, the desired time for degradation of the filter element, and the material adapted to catalyze hydrolysis chosen (to name a few).

For example, if an acid is chosen and the target time for degradation is 2-6 months, then, in one embodiment, the amount of acid may be in the range of 2-200% by weight of the cellulose acetate in the filter element. In another embodiment, using the same desired outcomes as above, the amount of acid may be in the range of 5-100% by weight of the cellulose acetate. In yet another embodiment, the amount of acid may be in the range of 10-50% by weight of the cellulose acetate.

If a base is chosen and the target time for degradation is 2-6 months, then the amount of base may be in the range of 50-500% by weight of the cellulose acetate in the filter element. In another embodiment, using the same desired outcomes as above, the amount of base may be in the range of 80-300% by weight of the cellulose acetate. In yet another embodiment, the amount of base may be in the range of 100-200% by weight of the cellulose acetate.

If a bacterium is chosen and the target time for degradation is 2-6 months, then the amount of bacterium is 1 to 5 billion colony forming units plus the needed food.

The amount of the water-soluble matrix material should be sufficient to completely encapsulate the material adapted to catalyze hydrolysis of the cellulose acetate. Completely encapsulate refers to covering and isolating the material, so that it can not catalyze hydrolysis until water has dissolved away the matrix material. Generally, the weight ratio of the material adapted to catalyze hydrolysis of the cellulose acetate to the water-soluble matrix material may be in the range of 0.75-4.0:1. In one embodiment, the ratio may be 2:1.

The combination of the material adapted to catalyze hydrolysis of the cellulose acetate and the water-soluble matrix material is in contact with the cellulose acetate of the filter element, but is not added into the cellulose acetate dope during spinning of the cellulose acetate tow. The combination of the hydrolysis catalyzing material and the matrix material may be, for example, a coating on the cellulose acetate tow, a coating on the plug wrap, and/or a pill added into the cellulose acetate tow. Each of these will be discussed in greater detail below.

The combination of the hydrolysis catalyzing material and the matrix material may be coated onto the cellulose acetate tow. In one embodiment, this combination may be coated onto the tow prior to formation of the filter element. For example, in a conventional rod making machine, a solution of the combination may be sprayed onto the bloomed tow prior to or as that tow passes the garniture. Alternatively, after the filter element is formed, a solution of the combination may be injected (e.g., via a syringe) into the tow.

Figure 1A:
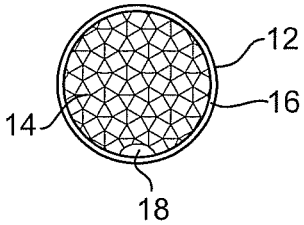
FIG. 1*a* is a cross-sectional view of the filter rod shown in FIG. 1 taken along sectional lines 1*a*-1*a*.
Figure 2:
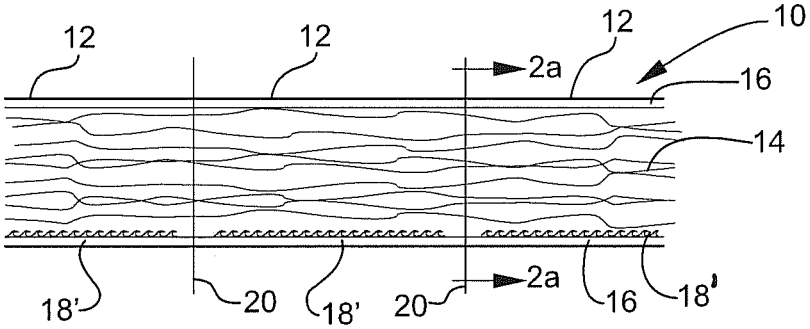
FIG. 2 is an illustration of another filter rod made according to the present invention.
Figure 2A:
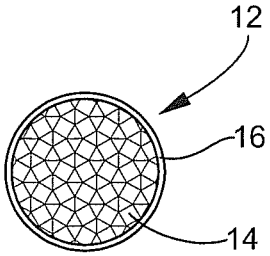
FIG. 2*a* is a cross-sectional view of the filter rod shown in FIG. 2 taken along sectional lines 2*a*-2*a*.

The combination of the hydrolysis catalyzing material and the matrix material may be coated onto the plug wrap. In one embodiment, this combination may be coated (or applied) as a line on an inside surface of the plug wrap. FIGS. 1 and 2 illustrate alternate embodiments. In FIG. 1, filter rod 10 comprises a plurality of filter elements 12. Each filter element 10 includes tow 14, plug wrap 16 surrounding tow 14, and a bead 18 of the combination coating an inside surface of the plug wrap 16. The bead 18 is continuous and in contact with tow 14. In FIG. 1*a*, bead 18 is visible (or exposed) when the filter element 12 is cut along cut lines 20. In FIG. 2, filter rod 10 comprises a plurality of filter elements 12. Each filter element 12 includes tow 14, plug wrap 16 surrounding tow 14, and a bead 18' of the combination coating an inside surface of the plug wrap 16. The bead 18' is discontinuous (or intermittent) and in contact with tow 14. In FIG. 2*a*, bead 18' is not visible (or not exposed) when the filter element 12 is cut along cut lines 20.

The combination of the hydrolysis catalyzing material and the matrix material may be a pill added into the cellulose acetate tow. Pill, as used herein, may refer to, for example: a single pill comprising the combination of the hydrolysis catalyzing material and the matrix material (which may or may not be enclosed in a gelatin capsule), or granules of the combination, or a powder of the combination, or a tablet of the combination (e.g., the combination alone or with a conventional tablet binder). The pill may be added to the cellulose acetate of the filter element prior to (or as) the filter element is being formed. For example, in a conventional rod making machine, a pill of the combination may be inserted into the bloomed tow prior to or as that tow passes the garniture.

The foregoing technology, while developed for cigarette filters made of cellulose acetate tow, may be applied to other articles made of cellulose esters. Cellulose esters may include, for example: cellulose acetate (D.S. of 2.0 to 3.0), cellulose acetate butyrate, cellulose acetate propionate, and the like. Such articles may include, for example, coffee cup lids, ski mask visors, tooth brushes, umbrella and handbag handles, eye glass frames, screwdriver handles, costume jewelry, absorbent cores (diapers, meat pads), triacetate films (LCD television), diacetate acetate films (packaging films for bakery products), and the like. In the foregoing the mixture of the water-soluble matrix material and the material adapted to catalyze the hydrolysis of the cellulose ester are applied to the article made of the cellulose ester.

The foregoing shall be further demonstrated by way of the following non-limiting examples.

EXAMPLES

To demonstrate that the material adapted to catalyze hydrolysis of the cellulose acetate can be isolated from the cellulose acetate prior to wetting and released from the water-soluble matrix material after wetting, two solutions were prepared. The first solution included 16% by weight of a plasticized cellulose acetate filter element of ascorbic acid in a 1:1 weight ratio with hydroxypropyl cellulose (HPC), and both were dissolved in water (100% water by weight of the ascorbic acid and HPC). The second solution was the same as the first except that 19% citric acid was used. The solutions were applied as a glue line (continuous bead) on the inside surface of the plug wrap during rod making. After rod making, the plug wrap was removed from the cellulose acetate tow, and the tow's pH was checked. Neither sample showed any evidence that acid had contaminated the tow. Then, the plug wrap was wetted. After 5 minutes, a pH paper was applied to the wetted area (citric acid sample) and the paper changed color indicating acid had been released. In the ascorbic acid samples, the rods themselves changed color (indicating oxidation of the ascorbic acid). The color change indicated that ascorbic acid had been released.

A time study was done to determine hydrolysis rates of cellulose acetate filters treated with acids, acid salts, and bases (Citric Acid, Lactic Acid, Ascorbic Acid, Sodium Hydrogen Sulfate, Sodium Hydroxide). For each, 0.1 molar (0.1M) and 1 molar (1M) solutions were prepared. Then the plug wrap was removed from 180 plasticized filter rods. These rods were grouped into 18 sets of 10 filter rods each.

Figure 3:
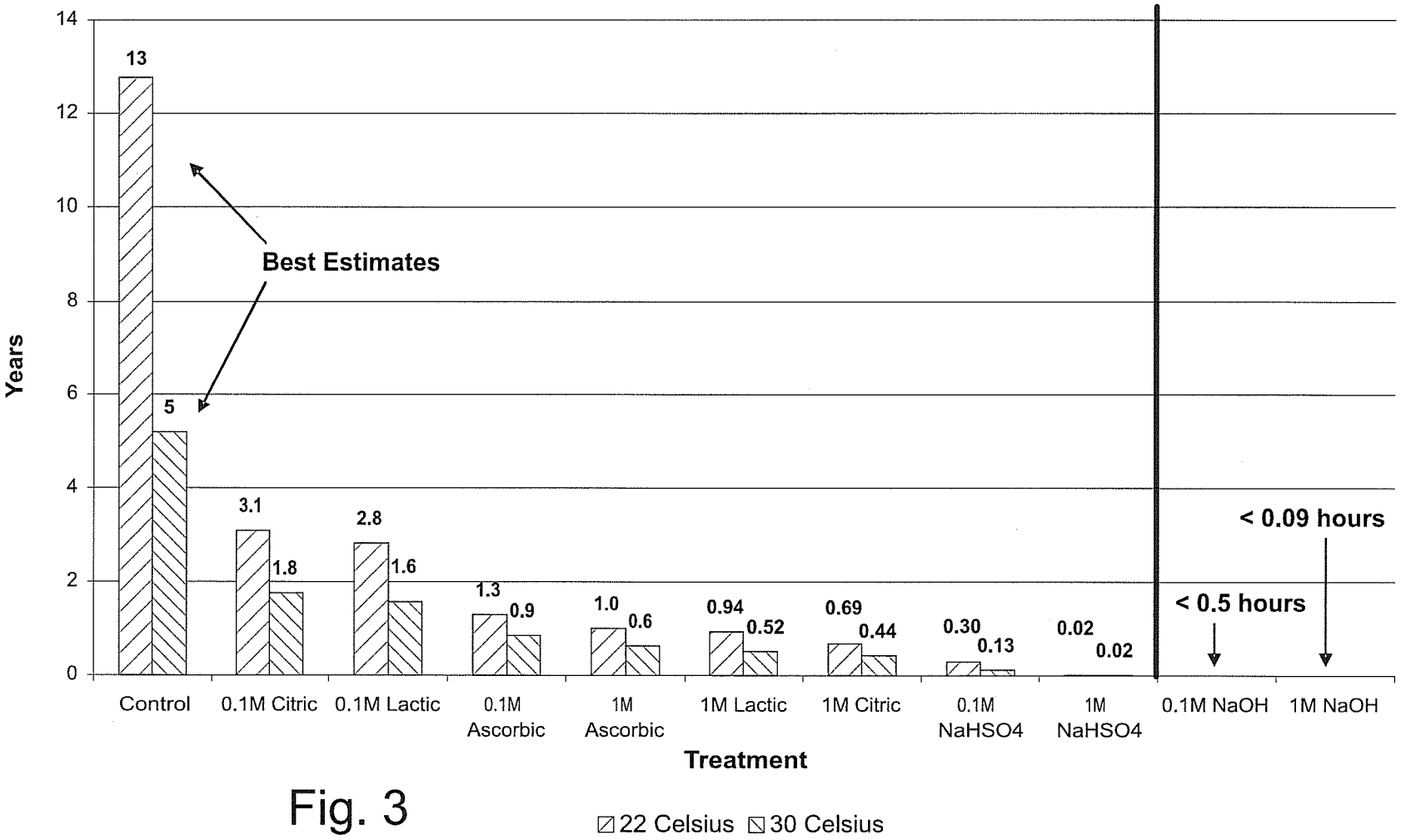
FIG. 3 is a graph illustrating the time to reduce cellulose acetate filter rods from 2.5 to 1 Degree of Substitution (D.S.) by certain acids, acid salts, and bases.
Figure 4:
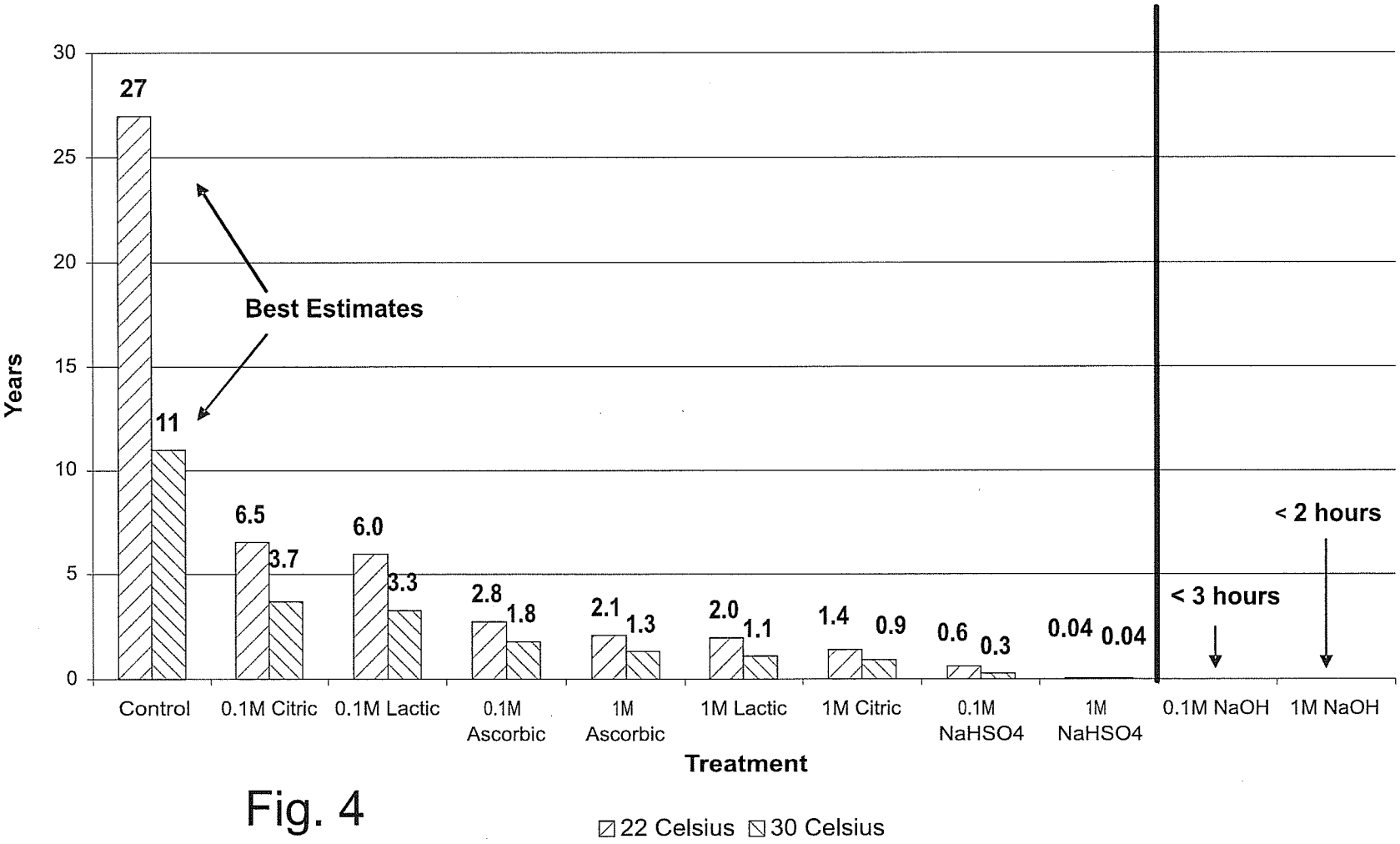
FIG. 4 is a graph illustrating the time to reduce cellulose acetate filter rods from 2.5 to 0 Degree of Substitution (D.S.) by certain acids, acid salts, and bases.

To apply the solutions, 10 rods were dipped into the solution (0.1 M or 1M) to saturate the rod (approximately 10 seconds). The rod was removed and allowed to drip 10 seconds. Then the rod was placed on a standard Kimwipe to air dry (lab condition 60% RH, 70° F.). The treatment was continued with the remaining solutions/rods. It should be noted that two temperatures were used for this work (22 and 30 Celsius). Therefore, 20 rods were treated per solution. Once dry, the rods were placed in jars and sealed. A Fisher incubator oven was used for the 30 Celsius samples. At 1 week intervals, a filter rod was removed from all samples and tested for acetyl value (% acetic acid). The acetyl value was determined using a high performance liquid chromatography method with a light scattering detector. (see: T. R. Floyd, *Chemical Characterization of Cellulose Acetate by Non-Exclusion Liquid Chromatography*, Journal of Chromatography, 629 (1993) pp. 243-254.) The collected data was regressed and the acetyl loss/time (hydrolysis rate or slope) was determined. Now one can determine the time to hydrolyze cellulose acetate with a 2.5 degree of substitution (D.S.) to 1 D.S. or 0 D.S. This is summarized in FIGS. 3 and 4. It should be noted that sodium hydroxide rate is measured in hours not years. Obviously, these trial cells did not dry like the tested acids. The acetyl value was determined by titration to a penolphthalein endpoint.

The present invention may be embodied in other forms without departing from the spirit and the essential attributes thereof, and, accordingly, reference should be made to the appended claims, rather than to the foregoing specification, as indicating the slope of the invention.

We claim:

1. A degradable cigarette filter where said cigarette filter includes a filter element of a bloomed cellulose acetate tow, the cellulose acetate having a degree of substitution in the range of 2.0 to 2.6, and a plug wrap surrounding said filter element comprising:

a coating composed of a mixture of a water-soluble matrix material and a material adapted to catalyze hydrolysis of said cellulose acetate tow being selected from the group consisting of an acid, an acid salt, and combinations thereof, said mixture having a weight ratio of the material to catalyze hydrolysis of said cellulose acetate tow to said water-soluble matrix in the range of 0.75-4.0:1, said coating being applied to the plug wrap after the tow is manufactured, whereby water dissolves said matrix material and exposes said material adapted to catalyze hydrolysis to said tow, and said material adapted to catalyze hydrolysis degrades said tow.

2. The degradable cigarette filter according to claim 1 wherein said material adapted to catalyze hydrolysis of said cellulose acetate tow comprises a material with a $pK_a<6$.

3. The degradable cigarette filter according to claim 1 wherein said acid is selected from the group consisting of: acetic, ascorbic, ascorbyl-2-phosphate, ascorbyl-2-sulfate, aspartic (aminosuccinic), cinnamic, citric, folic, glutaric, lactic, malic (1-hydroxysuccinic), nicotinic (nician), oxalic, succinic, tartaric, boric, hydrochloric, nitric, phosphoric, sulfuric, and combinations thereof.

4. The degradable cigarette filter according to claim 1, wherein said acid is a combination of a weak organic acid and a component that can be hydrolyzed to a strong acid.

5. The degradable cigarette filter according to claim 4 wherein said weak organic acid is selected from the group consisting of ascorbic acid, citric acid, lactic acid, nicotinic acid, hydroxysuccinic acid (apple acid), and combinations thereof.

6. The degradable cigarette filter according to claim 4 wherein said compound that can be hydrolyzed to a strong acid is selected from the group consisting of: cellulose sulfate, dodecyl sulfate, ascorbyl-2-sulfate, ascorbyl-2-phosphate, phosphorus pentoxide, phosphorus pentoxide based esters, cellulose nitrate, 2-ethyl hexyl phosphate, and combinations thereof.

7. The degradable cigarette filter according to claim 1 wherein said acid salt being metal salt where said metal being selected from the group consisting of: aluminum, potassium, sodium, or zinc, and the non-metal portion of the salt being selected from the group consisting of nitrates, dihydrogen phosphates, hydrogen phosphates, phosphates hydrogen sulfates, sulfates and combinations thereof.

8. The degradable cigarette filter according to claim 1 wherein said water-soluble matrix material being selected from the group consisting of: cellulose acetate (D.S.=0.8±0.2), carboxymethyl cellulose, ethyl cellulose, hydroxypropyl cellulose, hydroxypropyl methyl cellulose, methyl cellulose, polyethylene glycol, polyvinyl acetate, polyvinyl alcohol, starch, sugar, and combinations thereof.

9. The degradable cigarette filter according to claim 8 wherein said sugar being selected from the group consisting of: glucose, sucrose, lactose, and combinations thereof.

10. The degradable cigarette filter according to claim 1 wherein said material adapted to catalyze hydrolysis of said cellulose acetate tow being said acid, then said acid comprising 2-200% by weight of said cellulose acetate tow.

11. A degradable cigarette filter where said cigarette filter includes a filter element of a bloomed cellulose acetate tow and a plug wrap surrounding said filter element comprising: a coating consisting of a mixture of a water-soluble matrix material and a material adapted to catalyze hydrolysis of said cellulose acetate tow being selected from the group consisting of an acid, an acid salt, and combinations thereof, said coating being applied to the plug wrap after the manufacture of the tow, whereby water dissolves said matrix material and exposes said material adapted to catalyze hydrolysis to said tow, and said material adapted to catalyze hydrolysis degrades said tow.

* * * * *